US010056061B1

(12) United States Patent
Graham et al.

(10) Patent No.: US 10,056,061 B1
(45) Date of Patent: Aug. 21, 2018

(54) GUITAR FEEDBACK EMULATION

(71) Applicant: HARMAN INTERNATIONAL INDUSTRIES, INCORPORATED, Stamford, CT (US)

(72) Inventors: Brandon Graham, Sandy, UT (US); Norm Campbell, Delta (CA); Glen A. Rutledge, Victoria (CA)

(73) Assignee: Harman International Industries, Incorporated, Stamford, CT (US)

( * ) Notice: Subject to any disclaimer, the term of this patent is extended or adjusted under 35 U.S.C. 154(b) by 5 days.

(21) Appl. No.: 15/584,396

(22) Filed: May 2, 2017

(51) Int. Cl.

| | |
|---|---|
| ***G10H 1/06*** | (2006.01) |
| ***G10H 1/02*** | (2006.01) |
| ***G10H 1/12*** | (2006.01) |
| ***G10H 3/26*** | (2006.01) |
| ***G10H 5/00*** | (2006.01) |
| *G10H 3/18* | (2006.01) |

(52) U.S. Cl.
CPC ..... *G10H 1/02* (2013.01); *G10H 1/125* (2013.01); *G10H 3/26* (2013.01); *G10H 5/007* (2013.01); *G10H 3/18* (2013.01); *G10H 2250/521* (2013.01); *G10H 2250/531* (2013.01)

(58) Field of Classification Search
CPC .. G10H 3/26; G10H 7/00; G10H 1/02; G10K 15/02; H03F 2200/03; H03F 3/68
See application file for complete search history.

(56) References Cited

U.S. PATENT DOCUMENTS

| | | | | |
|---|---|---|---|---|
| 8,290,769 | B2 * | 10/2012 | Taub | G10L 25/90 704/207 |
| 8,378,200 | B1 * | 2/2013 | Beigel | G10H 1/0025 84/610 |
| 8,865,992 | B2 * | 10/2014 | Shavit | G10H 1/055 84/615 |
| 9,247,342 | B2 * | 1/2016 | Croft, III | H04R 1/2811 |
| 9,401,153 | B2 * | 7/2016 | Sharma | G10L 19/018 |
| 2003/0210797 | A1 | 11/2003 | Kreifeldt et al. | |
| 2004/0264705 | A1 * | 12/2004 | Hiipakka | H03G 5/165 381/71.1 |
| 2006/0056644 | A1 | 3/2006 | Kreifeldt et al. | |
| 2008/0225168 | A1 * | 9/2008 | Ouslis | H04N 5/4401 348/554 |
| 2008/0225174 | A1 * | 9/2008 | Greggain | H04N 5/46 348/572 |
| 2011/0135098 | A1 * | 6/2011 | Kuhr | H04S 3/004 381/17 |

(Continued)

*Primary Examiner* — Marlon Fletcher
(74) *Attorney, Agent, or Firm* — Brooks Kushman P.C.

(57) ABSTRACT

A frequency-domain peak detector is configured to detect harmonic content of a digital input signal. An equalizer-based feedback synthesizer is configured to generate simulated feedback at a specified frequency by filtering existing content of the digital input signal at the specified frequency. A tone-based feedback synthesizer is configured to generate simulated feedback at the specified frequency by generating a tone at the specified frequency. Feedback selection logic is configured to determine the specified frequency at which to generate simulated feedback based on the harmonic content, and whether to utilize the equalizer-based feedback synthesizer or the tone-based feedback synthesizer to generate simulated feedback at the specified frequency.

21 Claims, 4 Drawing Sheets

(56) References Cited

U.S. PATENT DOCUMENTS

| | | | | |
|---|---|---|---|---|
| 2012/0294457 | A1* | 11/2012 | Chapman | G10H 1/0091 381/98 |
| 2012/0294459 | A1* | 11/2012 | Chapman | G10H 3/186 381/98 |
| 2013/0202117 | A1* | 8/2013 | Brungart | H04R 5/04 381/17 |
| 2013/0263721 | A1* | 10/2013 | Shavit | G10H 1/055 84/626 |
| 2014/0039883 | A1* | 2/2014 | Yang | G10H 1/366 704/207 |
| 2015/0063597 | A1* | 3/2015 | Daly | H04S 7/302 381/104 |
| 2016/0080863 | A1 | 3/2016 | Rutledge et al. | |
| 2017/0265015 | A1* | 9/2017 | Daly | H04S 7/302 |

* cited by examiner

GUITAR FEEDBACK EMULATION

TECHNICAL FIELD

Aspects of the disclosure generally relate to electronic approaches for the simulation of guitar feedback.

BACKGROUND

Acoustic guitar feedback naturally occurs when output from an amplifier or speaker excites the strings of a guitar. This then creates a signal to send to the speakers, thereby creating an additive loop. Guitar feedback is different from standard microphone acoustic feedback, because the guitar strings excite in such a way as to keep feedback at the resonant frequency of the guitar string (or a harmonic of that frequency). In some cases, the guitar body and/or pickup may begin to resonate, but such feedback is not usually musical or desirable. Guitar feedback can be manipulated by guitar players in a musical manner, and is therefore considered by some players to be desirable.

A limiting factor in the creation of natural guitar feedback is that extreme output levels are typically required from the amplifier in order for the sound waves to have enough energy to sufficiently excite the guitar strings. Moreover, if guitar feedback is successfully obtained, it can be quite hard to get feedback to occur at the desired harmonic of the note being played.

SUMMARY

In one or more example embodiments of a system for simulating feedback, a frequency-domain peak detector is configured to detect harmonic content of a digital input signal. An equalizer-based feedback synthesizer is configured to generate simulated feedback at a specified frequency by filtering existing content of the digital input signal at the specified frequency. A tone-based feedback synthesizer is configured to generate simulated feedback at the specified frequency by generating a tone at the specified frequency. Feedback selection logic is configured to determine the specified frequency at which to generate simulated feedback based on the harmonic content, and whether to utilize the equalizer-based feedback synthesizer or the tone-based feedback synthesizer to generate simulated feedback at the specified frequency.

In one or more example embodiments, a method for simulating feedback includes tracking one or more notes in an input signal for which to generate simulated feedback; for each of the notes, selecting a specified frequency for generating simulated feedback as a multiple of a frequency of the respective note; and for each of the specified frequencies, based on a combination of whether harmonic content at the specified frequency meets a predefined threshold level and the multiple being used, generating the simulated feedback by filtering existing content of the input signal at the respective specified frequency or by generating a tone at the respective specified frequency.

In one or more example embodiments, a non-transitory computer readable medium includes instructions for simulating feedback that, when executed by an audio processor, cause the audio processor to track a note in an input signal for which to generate simulated feedback; select a specified frequency for generating simulated feedback as a multiple of a frequency of the note; responsive to determining that harmonic content at the specified frequency is at least meeting a predefined threshold level and that configuration rules of the audio processor allow for use of equalizer-based feedback for the multiple, generate simulated feedback at the specified frequency by filtering existing content of the input signal at the specified frequency; and responsive to determining that harmonic content at the specified frequency is not meeting the predefined threshold level and that configuration rules of the audio processor allow for use of tone-based feedback for the multiple, generate simulated feedback at the specified frequency by generating a tone at the specified frequency.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

An improved simulated feedback effect system is proposed. The system algorithmically detects the harmonic content of a digital input signal. Using the harmonic content, the system tracks selected notes and decides on feedback frequencies for the tracked notes. Also based on the harmonic content, the system determines whether to generate equalizer-based simulated feedback that boosts existing content of the signal or to generate tone-based simulated feedback that uses generated sounds not present in the input signal. The system then synthesizes feedback at the desired frequency, and adds the synthesized feedback to the input signal to create a final signal. This implementation of feedback synthesis and frequency selection allow natural-sounding feedback to occur in environments where natural feedback would be physically impossible, such as when playing guitar with headphones and no amplifier, or when recording directly into a recording interface. Moreover, this system allows for the generation of feedback from a signal that contains little to no harmonic content at the desired feedback frequency. In fact, the system allows a user to create feedback at any desired frequency, even if that frequency is not found in the original signal. Yet further, since actual string excitation is not required, the feedback synthesis may also more broadly apply to other instruments, and could be applied to generic audio as a software algorithm in a computer. Further aspects of the generation of simulated feedback are discussed in detail herein.

Figure 1:
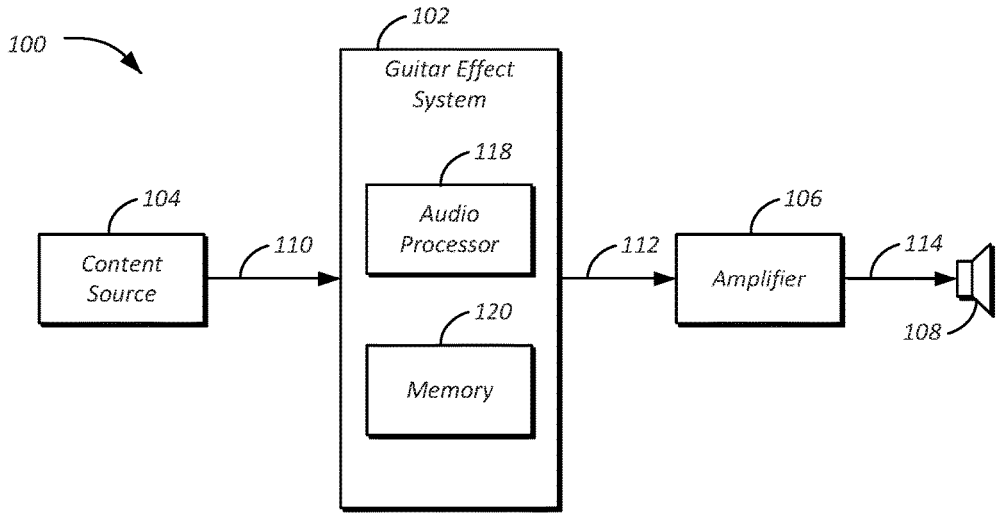
FIG. 1 is an example audio system that includes a guitar effect system for producing simulated feedback.

FIG. 1 is an example audio system 100 that includes a guitar effect system 102 for producing simulated feedback. The audio system 100 may also include at least one source of audio content 104 (e.g., an electric guitar), at least one guitar amplifier 106, and a plurality of loudspeakers 108. The guitar effect system 102 receives audio input signals 110 from the audio source 104, utilizes an audio processor 118 and memory 120 to process the audio input signals 110 into audio output signals 112, and provide the audio output signals 112 to the guitar amplifier 106 to drive one or more loudspeakers 108. An example guitar effect system 102 may include a standalone guitar effect pedal. In other examples, the functionality of the guitar effect system 102 may be included within a multi-effect pedal board or within the guitar amplifier 106 itself.

In many examples, the source of audio content 104 may be an electric guitar. For instance, the source of audio content 104 may produce an audio signal from one or more pickup devices of the guitar. In other cases, the source of audio content 104 may be prerecorded guitar signal. In yet further examples, the source of audio content 104 may include another instrument that is not a guitar, such as a violin or piano, or even a purely synthesized sound that is generated using an electronic keyboard or other computing device.

The amplifier 106 may be any circuit or standalone device that receives audio input signals of relatively small magnitude, and outputs similar audio signals of relatively larger magnitude. Audio input signals may be received by the amplifier 106 on one or more audio signals 112 and output on two or more loudspeaker connections 114. In addition to amplification of the amplitude of the audio signals, the amplifier 106 may also include signal processing capability to shift phase, adjust frequency equalization, adjust delay, or perform any other form of manipulation or adjustment of the audio signals in preparation for being provided to the loudspeakers 108. The signal processing functionality may additionally or alternately occur within the guitar effect system 102. Also, the amplifier 106 may include capability to adjust volume, balance, and/or fade of the audio signals provided on the loudspeaker connections 114. In an alternative example, the amplifier 106 may be omitted, such as when the loudspeakers 108 are in the form of a set of headphones, or when the audio output signals serve as the inputs to another audio device, such as an audio storage device or audio processor device. In still other examples, the loudspeakers 108 may include the amplifier, such as when the loudspeakers 108 are self-powered.

The loudspeakers 108 may be positioned in a listening space such as a room, a vehicle, outdoors, or in any other space where the loudspeakers 108 can be operated. The loudspeakers 108 may be any size and may operate over any range of frequency. Each loudspeaker connection 114 may supply a signal to drive one or more loudspeakers 108. Each of the loudspeakers 108 may include a single transducer, or in other cases multiple transducers. The loudspeakers 108 may also be operated in different frequency ranges such as a subwoofer, a woofer, a midrange, and a tweeter. Multiple loudspeakers 108 may be included in the audio system 100.

The guitar effect system 102 may receive the audio input signals from the source of audio content 104 on the audio input signals 110. Following processing, the guitar effect system 102 provides processed audio signals on the audio output signals 112 to the amplifier 106. The guitar effect system 102 may be a separate unit or may be combined with the source of audio content 104, the amplifier 106, and/or the loudspeakers 108. Also, in other examples, the guitar effect system 102 may communicate over a network or communication bus to interface with the source of audio content 104, the audio amplifier 106, the loudspeakers 108, and/or any other device or mechanism (including other guitar effect systems 102).

One or more audio processors 118 may be included in the guitar effect system 102. The audio processors 118 may be one or more computing devices capable of processing audio and/or video signals, such as a computer processor, microprocessor, a digital signal processor, or any other device, series of devices or other mechanisms capable of performing logical operations. The audio processors 118 may operate in association with a memory 120 to execute instructions stored in the memory. The instructions may be in the form of software, firmware, computer code, or some combination thereof, and when executed by the audio processors 118 may provide the functionality of the guitar effect system 102. The memory 120 may be any form of one or more data storage devices, such as volatile memory, non-volatile memory, electronic memory, magnetic memory, optical memory, or any other form of data storage device. In addition to instructions, operational parameters, and data may also be stored in the memory 120. The guitar effect system 102 may also include electronic devices, electro-mechanical devices, or mechanical devices such as devices for conversion between analog and digital signals, filters, a user interface, a communications port, and/or any other functionality to operate and be accessible to a user and/or programmer within the audio system 100.

During operation, the guitar effect system 102 algorithmically detects the harmonic content of a digital input signal, tracks selected notes and decides on a feedback frequency, synthesizes feedback at the desired frequency, and adds the synthesized feedback to the input signal to create the final audio output signal 112. The audio output signals 112 may be provided, in an example, to the amplifier 106 to drive the loudspeakers 108. Further aspects of the processing of the guitar effect system 102 are described in detail below with respect to FIGS. 2-4.

Figure 2:
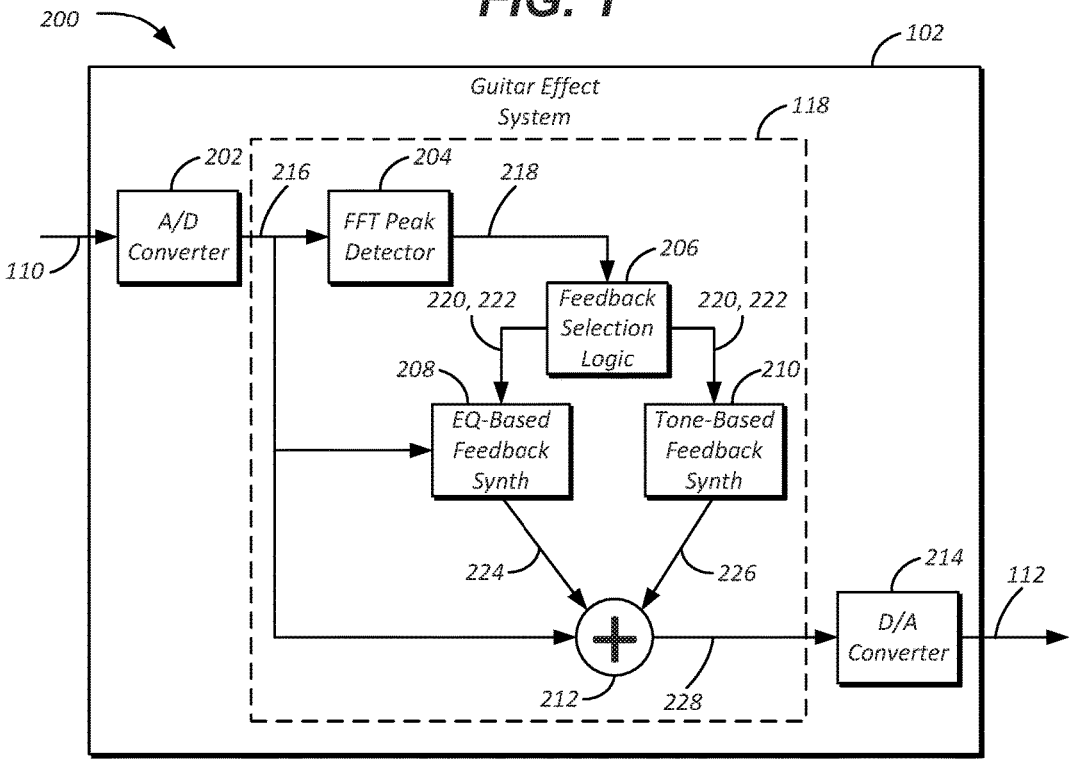
FIG. 2 is a block diagram example of functional processing blocks of the guitar effect system for producing simulated feedback.

FIG. 2 is a block diagram example 200 of functional processing blocks of the guitar effect system 102 for producing simulated feedback. As illustrated, the guitar effect system 102 includes an analog-to-digital (A/D) converter 202, a fast-Fourier-transform (FFT) peak detector 204, feedback selection logic 206, an equalizer-based feedback synthesizer 208, a tone-based feedback synthesizer 210, an output mixer 212, and a digital-to-analog (D/A) converter 214.

The A/D converter 202 receives the audio input signals 110 and converts them from an analog format to a digital input signal 216 in a digital input format for further processing by the audio processor 118. In an example, the functions performed by the audio processor 118 encompass those in the digital domain, e.g., of the fast-Fourier-transform (FFT) peak detector 204, feedback selection logic 206, equalizer-based feedback synthesizer 208, tone-based feedback synthesizer 210, and output mixer 212 functional blocks.

The FFT peak detector 204 receives the digital input signal 216, utilizes Fourier transformations to detect the harmonic content of the digital input signal 216, and generates peak data 218 indicative of peak frequencies, magnitudes, and phases of the digital input signal 216. The FFT peak detector 204 may accordingly analyze the digital input signal 216 in the frequency domain.

The feedback selection logic 206 receives the peak data 218 from the FFT peak detector 204, tracks selected notes, and generates feedback data 220 indicative of frequencies, magnitudes, and phases for generation of simulated feedback.

Regarding frequencies, the feedback selection logic 206 determines which of the detected notes to track over time. The feedback selection logic 206 may track a single note or, in other cases may be programmed to track multiple notes at once. Factors which affect the determination of whether to track notes includes the frequency, magnitude, and phase of the detected notes, the relation of one detected note to another, the detected onset of a new note, or the way that one or more of these measured features changes over time. In an example, the feedback selection logic 206 may be programmed to track the note having the greatest magnitude over time. In another example, the feedback selection logic 206 may be programmed to limit tracking of notes to frequencies that are within the range of fundamental notes typically produced by the guitar (e.g., from about 80 Hertz to about 2 Kilohertz).

If one or more notes are determined to be tracked by the feedback selection logic 206, the feedback selection logic 206 is further programmed to identify a desired feedback frequency to be created for each tracked note. The desired feedback frequency may be determined to be a multiple of the frequency of the tracked note.

As some possibilities, the feedback selection logic 206 may be configured to direct simulated feedback at a set multiple of the detected fundamental frequency. For instance, the multiple of the frequency may be a first harmonic (i.e., unison) feedback at the frequency of the note itself, a second harmonic of the frequency of the tracked note (i.e., one octave above the note), a third harmonic of the frequency of the tracked note (i.e., an octave plus a fifth interval), a fifth harmonic of the frequency of the tracked note (i.e. two octaves above a major third interval of the original note), or a first subharmonic at an octave below the frequency of the tracked note.

As some other possibilities, the feedback selection logic 206 may be configured to direct simulated feedback at an algorithmically-determined multiple of the detected fundamental frequency. For instance, the multiple of the frequency may be set to allow for multiple various feedback frequencies in a lower harmonic range (e.g., restricted to prevent feedback at frequencies at or above the fifth harmonic) or to allow for multiple various feedback frequencies in a higher harmonic range without the low pass restrictions. Based on the setting, the feedback selection logic 206 identifies a feedback harmonic (e.g., once per note, changing mid-note, etc.). This choice may depend, in an example, on the harmonic balance of the digital input signal 216. For instance, the feedback selection logic 206 may select to utilize a feedback harmonic at which the digital input signal 216 has relatively strong harmonic energy already present (e.g., choose a third harmonic if the third harmonic is stronger than other harmonics, such as the second or fifth harmonic). Or as a third example, feedback selection logic 206 may select a harmonic which is closest to a specified frequency, e.g., 800 Hz as one possibility, or which is the highest harmonic frequency which is still below some frequency threshold, say 800 Hz as one possibility. In yet another example, the choice by the feedback selection logic 206 may be random, e.g., based on random number generation. With regard to changing of the feedback frequency mid-note, the change in desired frequency may be determined based on various conditions, such as based on changes on the harmonic balance of the input signal 216 or randomly, as some examples.

The specific feedback frequency setting to use may be set according to settings 222 of the system 100, which may be configured using the control interface 400 as discussed in further detail below. In an example, the settings 222 may specify a feedback multiplier (e.g., first harmonic, second harmonic, third harmonic, fifth harmonic, first subharmonic, etc.) which may be used by the feedback selection logic 206 to determine the frequency for the simulated feedback. In another example, the settings 222 may specify for the feedback selection logic 206 to determine the feedback harmonic, and from that, the frequency of the simulated feedback.

Regarding magnitudes, the feedback selection logic 206 is further programmed to set a desired feedback level of the simulated feedback. In an example, the feedback selection logic 206 may set the desired feedback level to a gain setting of the settings 222 of the system 100.

To simulate natural feedback growth, the feedback selection logic 206 may further utilize an onset level of the settings 222 to determine the speed at which the simulated feedback increases to the specified gain level. The onset level is useful in the simulation of authentic-sounding feedback, as feedback typically increases for a period of time, then holds steady for a period of time, then decreases for a period of time. In an example, the feedback selection logic 206 may utilize linear growth or decay of the feedback level, while in other examples, the feedback selection logic 206 may utilize non-linear growth or decay of the feedback level (e.g., exponential, logarithmic, etc.).

Regarding phase, for a note that is being tracked, the feedback selection logic 206 may also determine a desired feedback phase. In an example, the feedback selection logic 206 further monitors the phase of the fundamental of the note being tracked. This phase information may then be used by the feedback synthesizers 208, 210 to ensure that the respective synthesized feedback 224, 226 (discussed in further detail below) is in phase with relevant content of the digital input signal 216.

Based on the feedback data 220 and the settings 222, the feedback selection logic 206 may direct the equalizer-based feedback synthesizer 208 to generate equalizer-based synthesized feedback 224 at the desired frequency. Further aspects of the operation of the equalizer-based feedback synthesizer 208 are discussed below with respect to FIG. 3A. Additionally, or alternately, based on the feedback data 220 and the settings 222, the feedback selection logic 206 directs the tone-based feedback synthesizer 210 to generate tone-based synthesized feedback 226 at the desired frequency. Further aspects of the operation of the tone-based feedback synthesizer 210 are discussed below with respect to FIG. 3B.

Figure 3A:
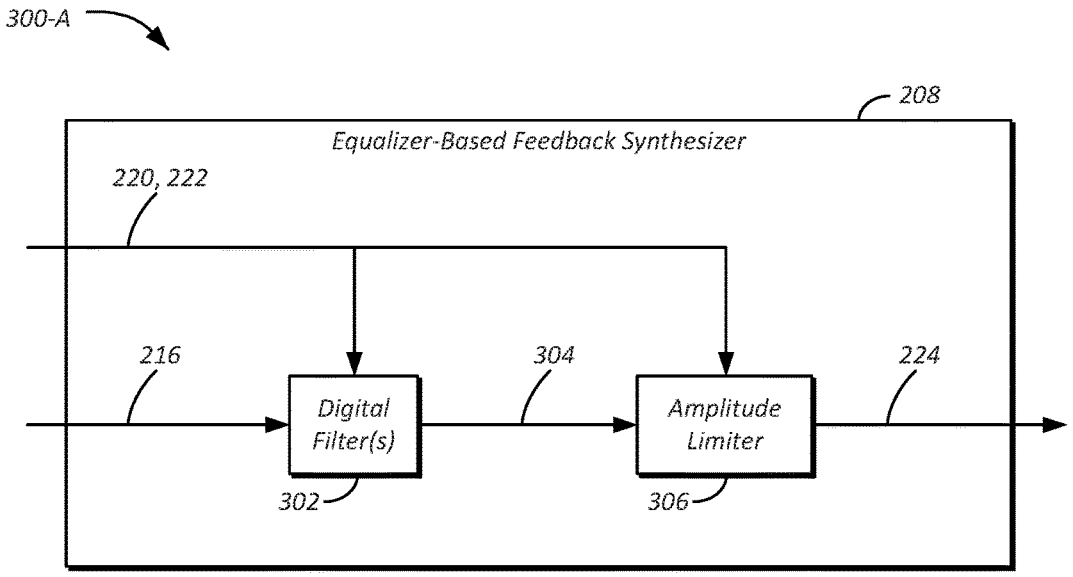
FIG. 3A is a block diagram example of functional processing blocks of the feedback synthesizer implementing a first method for producing simulated feedback.

FIG. 3A is a block diagram 300-A example of functional processing blocks of the equalizer-based feedback synthesizer 208. As illustrated, the equalizer-based feedback synthesizer 208 includes digital filters 302 that receive the digital input signal 216 from the A/D converter 202 and the feedback data 220 from the feedback selection logic 206. The digital filters 302 generate an equalizer-based raw feedback signal 304 using the digital input signal 216, which is then provided to an amplitude limiter 306. The amplitude limiter 306 scales the equalizer-based raw feedback signal 304 in accordance with the settings 222, and provides the equalizer-based synthesized feedback 224 as output.

More specifically, the equalizer-based raw feedback signal 304 may be created from the digital input signal 216 by processing it through digital filters 302 (e.g., a series of filters) which are tuned to the feedback frequency specified by the feedback data 220. The digital filters 302 accordingly emphasize the natural content of the digital input signal 216 near the desired feedback frequency. In an example, the frequency, q, and gain of the digital filter(s) 302 may be chosen by the feedback selection logic 206 based on the factors used to select the feedback frequency.

The equalizer-based raw feedback signal 304 may be output from the digital filters 302 and provided to the amplitude limiter 306. The amplitude limiter 306 may be programmed to ensure that the equalizer-based raw feedback signal 304 stays within a certain digital range before being added to the original digital input signal 216 by the output mixer 212. In an example, the amplitude limiter 306 may set the level of the equalizer-based raw feedback signal 304 to the desired gain setting of the settings 222. In another example, the amplitude limiter 306 may implement, in accordance with level information settings 222 received from the feedback selection logic 206, an increase in feedback level at the outset of feedback, followed by a hold in the feedback level for a period of time, followed by a decrease in the feedback level for a period of time.

This equalizer-based method for producing simulated feedback performed by the feedback synthesizer 208 has the advantage that the equalizer-based raw feedback signal 304 is created from the original signal. Thus, any subtle nuances in the digital input signal 216, such as pitch fluctuations, will be present in the equalizer-based raw feedback signal 304 as well. This may accordingly result in a more natural-sounding simulated feedback. Another benefit of this method is that since equalizer-based raw feedback signal 304 is created from the digital input signal 216, the feedback signal 304 is likely to be in phase with the input signal 216. In a scenario where acoustic feedback with a guitar or other instrument is possible, this increases the likelihood of the synthetic feedback eliciting more natural feedback in the actual acoustic system. However, as a disadvantage, this method is unable to generate feedback in cases where the input signal 216 has no content or very weak harmonic content at the frequency at which feedback is desired.

Figure 3B:
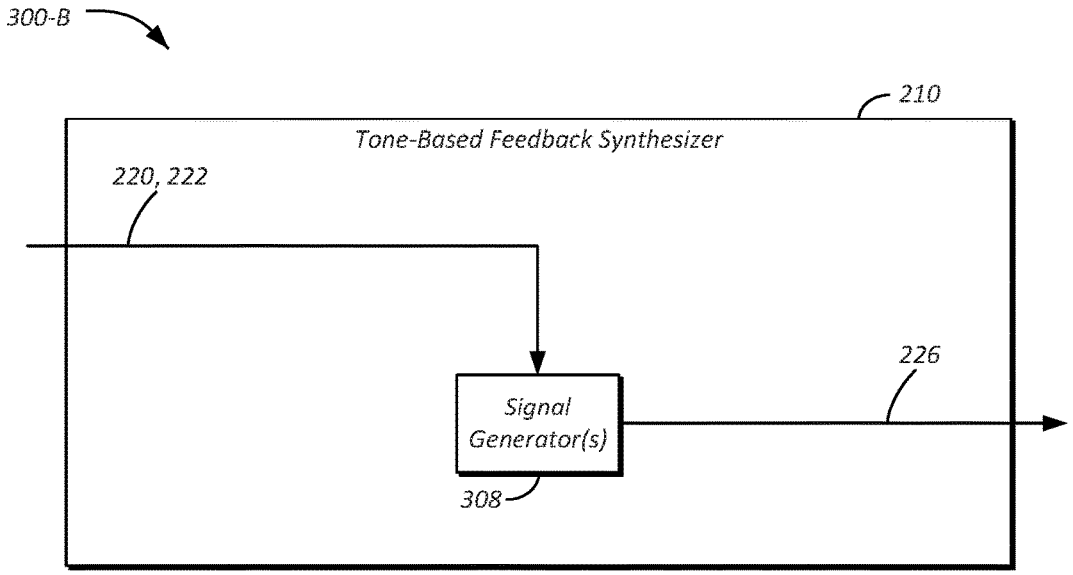
FIG. 3B is a block diagram example of functional processing blocks of the feedback synthesizer implementing a second method for producing simulated feedback.

FIG. 3B is a block diagram 300-B example of functional processing blocks of the tone-based feedback synthesizer 210. Instead of the digital filters 302 and amplitude limiter 306 of the equalizer-based feedback synthesizer 208, the tone-based feedback synthesizer 210 includes signal generators 308.

The signal generators 308 generate a simulated tone or tones to synthesize the tone-based synthesized feedback 226. Accordingly, the signal generators 308 allow for the tone-based feedback synthesizer 210 to generate simulated feedback without having to receive the digital input signal 216. Signal generators 308 can be implemented, in an example, as generators of pure tones such as sinusoidal tones, generators of totally arbitrary tones, or even generators that read in a stored tone from a memory for generation.

The signal generators 308 may also scale tone-based synthesized feedback 226 in accordance with the settings 222 in order to provide the tone-based synthesized feedback 226 as output. Thus, similar to as discussed above with respect to the feedback synthesizer 208, the level of the feedback signal 226 may be adjusted or generated as needed by the signal generators 308 in order to match the feedback level chosen according to the desired gain of the settings 222.

Importantly, the tone-based feedback synthesizer 210 has the advantage of synthesizing feedback at frequencies where the digital input signal 216 may have weak content or no content at all. This allows the synthesis of subharmonics or other harmonics which may be very weak or not present in the original digital input signal 216.

Referring back to FIG. 2, the feedback selection logic 206 is further configured to select whether simulated feedback is to be generated from the input signal 216 via the equalizer-based feedback synthesizer 208, or without the input signal via the tone-based feedback synthesizer 210.

Notably, certain feedback harmonics are more likely to require tone-generated feedback via the tone-based feedback synthesizer 210 instead of equalizer-based feedback via the equalizer-based feedback synthesizer 208. For instance, the feedback selection logic 206 may be configured for subharmonic feedback to use tone-generated feedback. This is because there is unlikely to be reliable natural content in the digital input signal 216 at a subharmonic of the note being played. However, the digital input signal 216 may be configured for first harmonic feedback to use equalizer-based feedback, because guitar or other notes tend to have a strong fundamental component (e.g., the signal already contains existing content available for boosting to create a feedback-like tone).

In another example, the feedback selection logic 206 may be configured to determine whether to use equalizer-based or tone-based simulated feedback according to the harmonic content of the digital input signal 216. For instance, if the feedback selection logic 206 is attempting to simulate feedback at a given harmonic (e.g., a third harmonic) and there is content below a threshold loudness at that frequency, then the feedback selection logic 206 may choose to utilize tone-based simulated feedback via the tone-based feedback synthesizer 210. It may be preferable in such a situation for the feedback selection logic 206 to select the tone-based simulated feedback instead of equalizer-based simulated feedback, because the content at the given harmonic may be noise or otherwise unmusical content that if boosted may not provide for a good sounding simulation of feedback. If, however, the content at the simulated frequency is at or above the threshold loudness, then the feedback selection logic 206 may choose to utilize equalizer-based simulated feedback via the feedback synthesizer 208. This may be advantageous, as using the existing content may provide for more natural-sounding simulated feedback, and may avoid issues with generated feedback being out-of-phase with existing content at the desired feedback frequency.

In some examples, the feedback selection logic 206 maintains configuration rules specifying criteria for whether one or both of equalizer-based feedback or tone-generated feedback is available. For instance, the configuration rules may indicate that first harmonic will sometimes use equalizer feedback and sometimes tone feedback, based on the harmonic strength. As another possible rule, subharmonics and fifth harmonics may be set by the rules to always use tone-based feedback.

The output mixer 212 processes the digital input signal 216, the synthesized feedback 224, and/or the synthesized feedback 226 to produce the digital output signal 228. In an example, the output mixer 212 sums the digital input signal 216, the synthesized feedback 224, and/or the synthesized feedback 226 to produce the digital output signal 228. Accordingly, the synthesized feedback 224, 226 may be added back to the original digital input signal 216 via a simple summing operation. Because natural feedback is additive, this summing is similar to what occurs with natural feedback. In another example, the output mixer 212 may be directed (e.g., by feedback selection logic 206) to generate a dry mix including only the synthesized feedback 224, and/or the synthesized feedback 226 but not the digital input signal 216.

The D/A converter 214 receives the digital output signal 228 and converts it from a digital format to an output signal 112 in an analog format. The output signal 112 may then be made available for use by the amplifier 106 or other analog components for further processing.

It should be noted that the flow for generation of simulated feedback is discussed in FIGS. 2, 3A and 3B in terms of a single note. However, multiple instances of feedback synthesizers 208, 210 may be included in other examples to allow for simultaneous simulation of the multiple feedback signals, each of which may be tracked and requested for synthesis by the feedback selection logic 206. Or, in other examples, feedback synthesizer 208, 210 may consist of multiple synthesizers which combine their outputs into a single feedback output signal.

Figure 4:
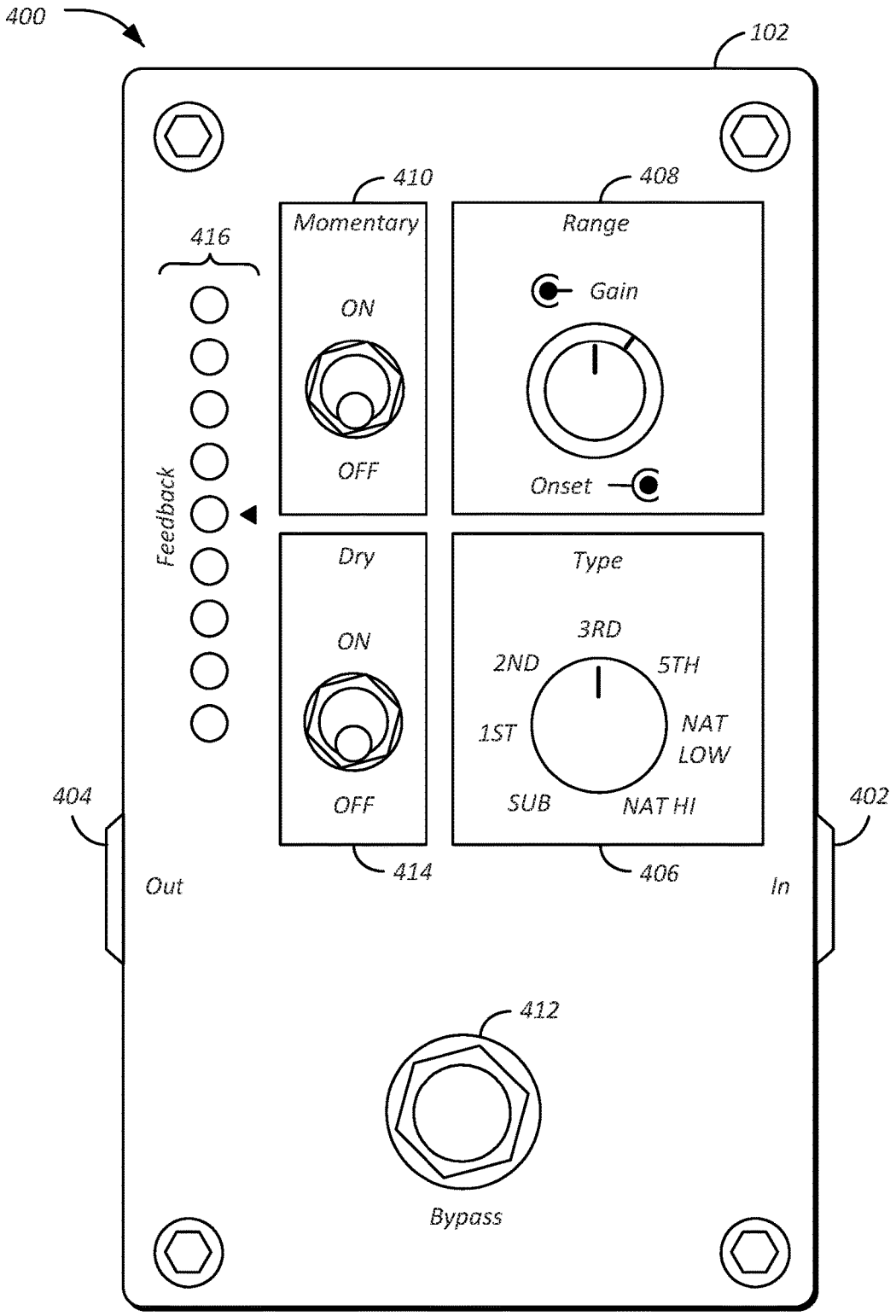
FIG. 4 is a block diagram example of a control interface of the guitar effect system for producing simulated feedback.

FIG. 4 is a block diagram example of a control interface 400 of the guitar effect system 102 for producing simulated feedback. As shown, the control interface 400 includes an input 402 for receiving the audio input signal 110 from the audio source 104, and an output 404 for providing the output signal 112 for further processing or use. In one example, the input 402 and output 404 may be ¼" phone jacks for receiving ¼" plugs. In another example, the input 402 and output 404 may be XLR jacks for receiving XLR connectors.

The control interface 400 further includes a feedback type control 406 from which a user can choose the type of simulated feedback to be created by the guitar effect system 102. In an example, and as mentioned above, the feedback type control 406 may allow for user selection from a first harmonic, a second harmonic, a third harmonic, a first subharmonic, multiple various feedback frequencies in a lower restricted harmonic range, and/or multiple various feedback frequencies in a higher harmonic range without the low pass restrictions. The feedback type control 406 is shown as a rotary control with positions for the different available feedback types (e.g., with 3rd harmonic selected), but other implementations and settings are possible. The feedback type control 406 may accordingly be used to allow a user to adjust the settings 222 related to the frequency desired for simulated feedback.

The control interface 400 also includes a range control 408 from which the user can choose the amount of gain or level for the simulated feedback, as well as the speed of onset of the simulated feedback. The amount of gain indicates the maximum level that the feedback attains, while the onset controls how long it takes for the feedback level to grow from zero to the amount set by the gain control. For instance, lower settings of the gain value may be used to provide for a subtler effect, while higher settings may be used to increase the feedback/sustain effect. Additionally, lower settings of the onset control may cause an effect that increases quickly with time, while higher settings of the onset control may cause an effect that increases more slowly with time. In the illustrated example, a dual knob with an outer ring for selection of onset and an inner knob for selection of gain is shown, but other types of controls are possible. As another possibility, onset and/or feedback gain may be selected by a treadle on a guitar pedal controlled manually by the user. Regardless of approach, the range control 408 may accordingly be used to allow a user to adjust the settings 222 related to the level and onset of the simulated feedback.

The control interface 400 may also include a momentary switch 410 and a bypass or effect switch 412. In the illustrated example, the effect switch 412 is a footswitch button operable by a foot of a user. The momentary switch 410 determines the operation of the effect switch 412. When the momentary switch 410 is set to the "ON" position, the simulated feedback effect may only be enabled if the effect switch 412 is held down. In an example, this mode may be used to apply feedback only to certain notes or passages during a performance. When the momentary switch 410 is set to the "OFF" position, the effect switch 412 operates as a standard effect pedal, where the effect toggles between enabled and bypassed modes each time the effect switch 412 is pressed. In an example, this mode may be used when simulated feedback is desired to be to be more prominent during a performance rather than being applied during specific notes or phrases. In some implementations, when the momentary switch 410 is set to the "ON" position, the guitar effect system 102 uses a buffered bypass signal path, while when the momentary switch 410 is set to the "OFF" position, the guitar effect system 102 provides a true bypass signal path.

A dry switch 414 of the control interface 400 controls whether the synthesized feedback 224, 226 is mixed in with the digital input signal 216 by the output mixer 212 to produce the output signal 112. When dry is set to "ON," the synthesized feedback 224, 226 is mixed in with the digital input signal 216 by the output mixer 212 to produce the output signal 112. When dry is set to "OFF," the synthesized feedback 224, 226 is provided in the output signal 112 without mixing in of the digital input signal 216.

The control interface 400 also includes a set of feedback lights 416. In an example, the feedback lights may include a string of light-emitting diodes (LEDs), arranged in a line such that when the simulated feedback is enabled, the middle LED light indicates that the effect is on. When the effect is enabled, the LEDs may light from the middle light out to display the onset rate of the feedback effect.

Figure 5:
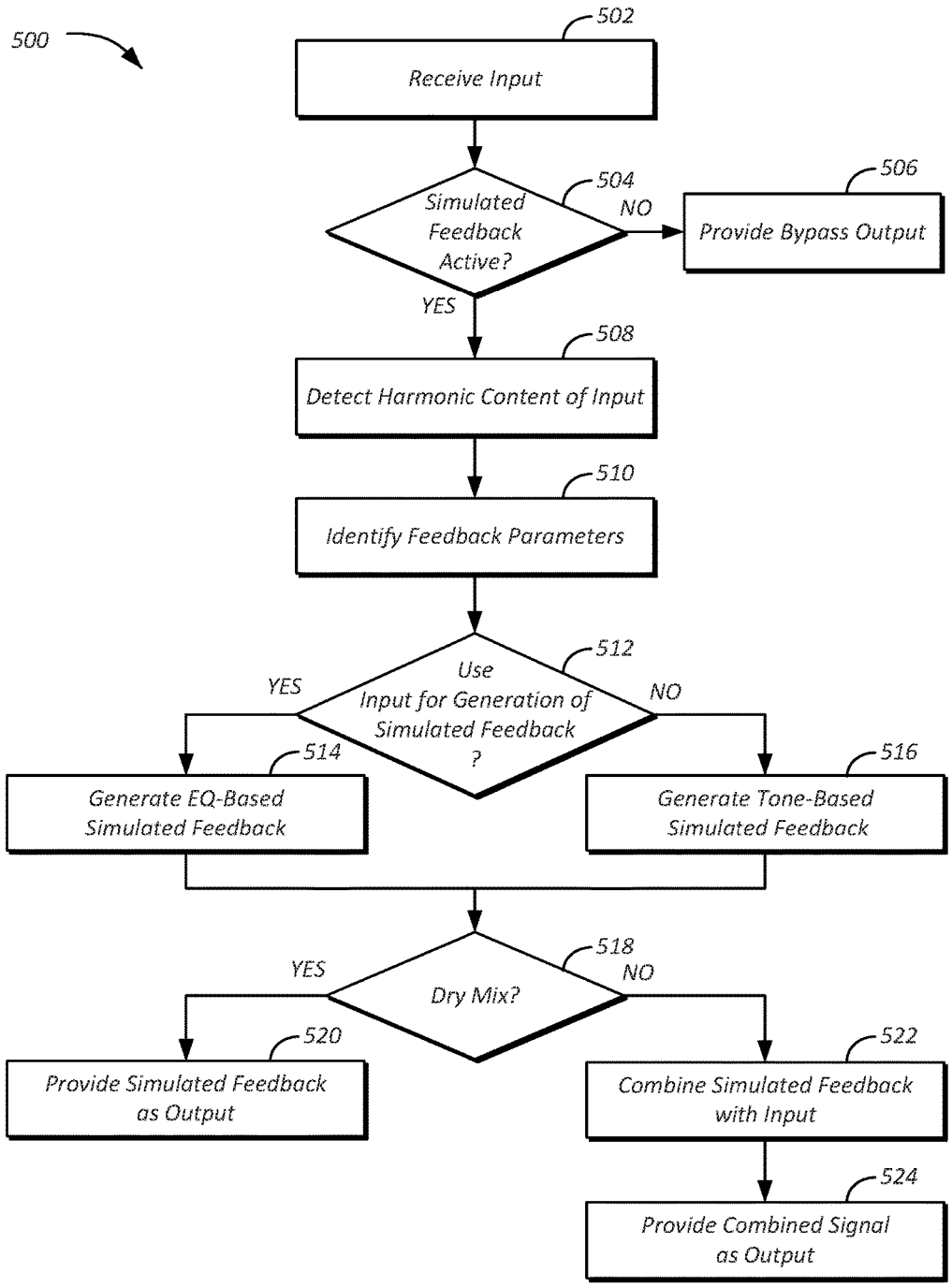
FIG. 5 is an example method for producing simulated feedback using the guitar effect system.

FIG. 5 is an example method 500 for producing simulated feedback using the guitar effect system 102. In an example, the operations of the method 500 may be performed by the guitar effect system 102 as described in detail above.

At operation 502, the guitar effect system 102 receives audio input signals 110 from the audio source 104. In an example, a user may play a guitar connected to the input 402 of the guitar effect system 102. In other cases, the source of audio content 104 may be prerecorded guitar signals. In yet further examples, the source of audio content 104 may include another instrument that is not a guitar, such as a violin or piano, or even a sound that is generated using an electronic keyboard or another computing device. Indeed, the audio input signals 110 may be any arbitrary audio signal (e.g., a full audio mix of multiple instruments).

At 504, the guitar effect system 102 determines whether simulated feedback is active. In an example, the guitar effect system 102 may identify based on the state of the momentary switch 410 and effect switch 412, and further based on the audio input signals 110, whether simulated feedback is desired. If not, control passes to operation 506. If so, control passes to operation 508.

The guitar effect system 102 provides the bypass output without simulated feedback at 506. In an example, the guitar effect system 102 provides the audio input signals 110 as the output signal 112 to the output 404, without processing. After operation 506, the method 500 ends.

In operation 508, the guitar effect system 102 detects the harmonic content of the audio input signals 110. In an example, the guitar effect system 102 passes the audio input signals 110 through the A/D converter 202 to convert the audio input signals 110 from an analog format to a digital input signal 216, followed by the FFT peak detector 204 to detect the harmonic content of the digital input signal 216. The FFT peak detector 204 accordingly generates peak data 218 indicative of peak frequencies, magnitudes, and phases of the digital input signal 216.

At 510, the guitar effect system 102 identifies feedback parameters to be used in the generation of the simulated feedback. In an example, the feedback selection logic 206 receives the peak data 218 from the FFT peak detector 204, tracks selected notes, and generates feedback data 220 indicative of frequencies, magnitudes, and phases for generation of simulated feedback. The harmonics to be selected for generation of simulated feedback may be determined according to the settings 222, as discussed in detail above.

The guitar effect system 102 determines whether to use the digital input signal 216 for generation of the simulated feedback at 512. In an example, the feedback selection logic 206 may determine to use equalizer-based simulated feedback via the feedback synthesizer 208 at the frequency specified by the feedback data 220 for generation of simulated feedback harmonic if the content at that frequency is at or exceeds a predefined threshold level. Otherwise, the feedback selection logic 206 may determine to use tone-based simulated feedback via the feedback synthesizer 210. In another example, the feedback selection logic 206 may choose to use equalizer-based simulated feedback via the feedback synthesizer 208 for the generation of predefined harmonic types (e.g., first harmonic), and may choose to use tone-based simulated feedback via the feedback synthesizer 210 for the generation of other predefined harmonic types (e.g., subharmonics). In yet a further example, the feedback selection logic 206 may utilize both the harmonic content and the requested feedback harmonic when determining whether to use equalizer-based or tone-based feedback. If the feedback selection logic 206 determines to use equalizer-based simulated feedback, control passes to operation 514. Otherwise, control passes to operation 516.

In operation 514, the guitar effect system 102 generates the simulated feedback using the digital input signal 216. In an example, the guitar effect system 102 may utilize the equalizer-based feedback synthesizer 208 to generate equalizer-based synthesized feedback 224, as discussed in detail above.

In 516, the guitar effect system 102 generates the simulated feedback without using the digital input signal 216. In an example, the guitar effect system 102 may utilize the tone-based feedback synthesizer 210 to generate tone-based synthesized feedback 226, as discussed in detail above.

The guitar effect system 102 determines whether to provide a dry mix as output at operation 518. In an example, the guitar effect system 102 determines, based on the state of the dry switch 414, whether to mix the digital input signal 216 into the synthesized feedback 224, 226. If a dry mix is selected, control passes to operation 522. If, however, a dry mix is not selected, control passes to operation 520.

In operation 520, the guitar effect system 102 provides the synthesized feedback 224, 226 as the output signal 112 to the output 404. For instance, the output mixer 212 may be set to mix in the synthesized feedback 224, 226 but not mix in any of the digital input signal 216 to produce the digital output signal 228. After operation 520, the method 500 ends.

At 522, the guitar effect system 102 mixes the synthesized feedback 224, 226 with the digital input signal 216. In an example, the output mixer 212 sums the digital input signal 216, the synthesized feedback 224, and/or the synthesized feedback 226 to produce the digital output signal 228. Accordingly, the synthesized feedback 224, 226 may be added back to the original digital input signal 216 via a simple summing operation. Because natural feedback is additive, this summing is similar to what occurs with natural feedback.

At operation 524, the guitar effect system 102 provides the combined signal as output. For instance, the guitar effect system 102 may pass the digital output signal 228 through the D/A converter 214 to provide an output signal 112. The output signal may be provided to the output 404 for further use. After operation 524, the method 500 ends.

Computing devices described herein, such as the audio processors 118 of the guitar effect system 102, generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, JavaScript, C, C++, C#, Visual Basic, Java Script, Python, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for simulating acoustic feedback comprising:

a frequency-domain peak detector configured to detect harmonic content of a digital input signal;

an equalizer-based feedback synthesizer configured to generate simulated acoustic feedback at a specified frequency by filtering existing content of the digital input signal at the specified frequency;

a tone-based feedback synthesizer configured to generate simulated acoustic feedback at the specified frequency by generating a tone at the specified frequency; and feedback selection logic configured to determine the specified frequency at which to generate simulated acoustic feedback based on the harmonic content, and whether to utilize the equalizer-based feedback synthesizer or the tone-based feedback synthesizer to generate simulated acoustic feedback at the specified frequency.

2. The system of claim 1, wherein the feedback selection logic is further configured to determine whether to utilize the equalizer-based feedback synthesizer or the tone-based feedback synthesizer to generate simulated acoustic feedback at the specified frequency based on the harmonic content.

3. The system of claim 1, wherein the feedback selection logic is further configured to:

identify a multiple of a fundamental frequency of a note responsive to user selection of a specific harmonic to use;

select the specified frequency according to the multiple; and determine whether to utilize the equalizer-based feedback synthesizer or the tone-based feedback synthesizer to generate simulated acoustic feedback at the specified frequency based on the multiple.

4. The system of claim 1, wherein the feedback selection logic is further configured to track a note in the digital input signal as identified in the harmonic content for which to generate simulated acoustic feedback, and select the specified frequency as a multiple of a frequency of the note.

5. The system of claim 4, wherein the feedback selection logic is further configured to identify the multiple responsive to user selection of a specific integer harmonic or subharmonic to use.

6. The system of claim 4, wherein the feedback selection logic is further configured to identify the multiple as a harmonic of the digital input signal at which the harmonic content shows a greatest amount of harmonic energy.

7. The system of claim 4, wherein the feedback selection logic is further configured to identify the multiple according to random selection from a set of possible harmonics.

8. The system of claim 1, further comprising an output mixer configured to the simulated acoustic feedback with the digital input signal to produce a combined digital output signal.

9. The system of claim 8, further comprising:

an analog-to-digital converter configured to convert an analog input signal into the digital input signal; and a digital-to-analog converter configured to convert the digital output signal into an analog output signal.

10. The system of claim 8, further comprising an amplitude limiter configured to utilize an onset level to determine a speed at which the simulated acoustic feedback increases to a specified gain level, and ramp up the simulated acoustic feedback from a zero level to the specified gain level according to the determined speed.

11. The system of claim 1, wherein the equalizer-based feedback synthesizer is further configured to perform the filtering by boosting the existing content at the specified frequency to generate a raw feedback signal, limiting the raw feedback signal using an amplitude limiter to generate equalizer-based simulated acoustic feedback, and providing the resultant equalizer-based simulated acoustic feedback to be mixed back into the digital input signal to produce a combined digital output signal.

12. A method for simulating acoustic feedback comprising:

tracking one or more notes in an input signal for which to generate simulated acoustic feedback;

for each of the notes, selecting a specified frequency for generating simulated acoustic feedback as a multiple of a frequency of the respective note; and for each of the specified frequencies, based on a combination of whether harmonic content at the specified frequency meets a predefined threshold level and the multiple of the frequency of the respective note being used, generating the simulated acoustic feedback by filtering existing content of the input signal at the respective specified frequency or by generating a tone at the respective specified frequency.

13. The method of claim 12, further comprising identifying the multiple for each of the notes responsive to a selection of a specific integer harmonic or subharmonic to use.

14. The method of claim 12, further comprising identifying the multiple for each of the notes as a harmonic of the input signal at which the harmonic content for the respective note shows a greatest amount of harmonic energy.

15. The method of claim 12, further comprising utilizing configuration rules for identifying, for the multiple, whether filtering, tone generation, or both are enabled for use in generating the simulated acoustic feedback.

16. The method of claim 12, further comprising combining the simulated acoustic feedback with the input signal to produce a combined signal output.

17. The method of claim 12, further comprising:

identifying the harmonic content of the input signal using a Fourier transform; and identifying the note based on an analysis of the harmonic content.

18. The method of claim 12, further comprising:

utilizing an onset level to determine a speed at which the simulated acoustic feedback increases to a specified gain level; and ramping up the simulated acoustic feedback from a zero level to the specified gain level according to the determined speed.

19. A non-transitory computer readable medium comprising instructions for simulating acoustic feedback that, when executed by an audio processor, cause the audio processor to:

track a note in an input signal for which to generate simulated acoustic feedback;

select a specified frequency for generating simulated acoustic feedback as a multiple of a frequency of the note;

responsive to determining that harmonic content at the specified frequency is at least meeting a predefined threshold level and that configuration rules of the audio processor allow for use of equalizer-based feedback for the multiple, generate simulated acoustic feedback at the specified frequency by filtering existing content of the input signal at the specified frequency; and responsive to determining that harmonic content at the specified frequency is not meeting the predefined threshold level and that configuration rules of the audio processor allow for use of tone-based feedback for the multiple, generate simulated acoustic feedback at the specified frequency by generating a tone at the specified frequency.

20. The medium of claim 19, further comprising instructions to cause the audio processor to identify the multiple of the frequency of the note in response to receiving selection of a specific integer harmonic or subharmonic to use.

21. The medium of claim 19, further comprising instructions to cause the audio processor to identify the multiple of the frequency of the note as a harmonic of the input signal at which the harmonic content shows a greatest amount of harmonic energy.

* * * * *